United States Patent [19]

Chen

[11] 4,437,381

[45] Mar. 20, 1984

[54] METRONOMIC SIGNALLING DEVICES AND METHOD OF TEMPO SIGNALLING

[76] Inventor: Shin H. Chen, 1725 N. LeClaire Ave., Chicago, Ill. 60639

[21] Appl. No.: 400,378

[22] Filed: Jul. 21, 1982

[51] Int. Cl.[3] ..... G10B 15/00

[52] U.S. Cl. ..... 84/484; 84/477 R

[58] Field of Search ..... 84/484, 477 B; 128/32, 128/41; 434/114; 340/384 E, 388

[56] References Cited

U.S. PATENT DOCUMENTS 2,535,809 12/1950 Niendorff ..... 84/484

3,901,121 8/1975 Kleiner ..... 84/484

4,033,053 7/1977 Engler ..... 434/114

4,282,681 8/1981 McCaslin ..... 84/477 B

*Primary Examiner*—E. A. Goldberg

*Assistant Examiner*—Todd E. DeBoer

*Attorney, Agent, or Firm*—Hill, Van Santen, Steadman & Simpson

[57] ABSTRACT

Metronomic signalling devices and method for generating and transmitting silent and nonvisible metronomic impulses by sense of touch, i.e., to the skin of a user so that the user thereby receives tempo guidance by feeling the impulses through the skin.

15 Claims, 8 Drawing Figures

METRONOMIC SIGNALLING DEVICES AND METHOD OF TEMPO SIGNALLING

This invention relates to metronomic signalling devices and method of tempo signalling, and is more particularly concerned with such devices and method which will provide silent dynamoelectric impulse tempo signals without acoustical interference.

Conventional metronomic devices transmit signals to the user audibly or visually, or both. Instruments for this purpose mark exact time by a regularly repeated tick or similar sound for audible guidance of a user, or by a flashing light or swinging pendulum in respect to the visual metronomic signals.

Both the audible (acoustic) and visual (optical) types of metronomic signalling have the shortcomings in that they may interfere with user concentration upon the effort intended to be enhanced by the signals. For example, during music making, the audible metronomic signals may interfere with proper concentration upon tone and pitch. Visual metronomic signalling may additionally interfere with concentration upon note reading.

An important object of the present invention is to overcome the aforementioned shortcomings in respect to the prior modes of metronomic signalling, and to provide a novel nonauditory, nonvisual method of and means for tempo signal transmission.

Another object of the invention is to provide metronomic signalling devices, and method for transmitting silent truly and noiseless electrodynamic motion impulse signals.

A further object of the invention is to provide a new and improved method of and means for nonauditory and nonvisual metronomic signalling by use of a device adapted to be carried by the user.

In accordance with the present invention, there is provided a silent metronomic pulsing device, comprising a housing having an opening, a soundproof relatively soft yieldably movable transmission pad fixed across the opening and having a texture accentuated face projecting outwardly from the housing for tempo-signal-imparting engagement with a user, and a surface of substantial area facing inwardly into the housing; transducer means comprising a disk-like member fixed to and movable with the inwardly facing surface of the soundproof pad and covering a major portion of the inwardly facing pad area, dynamoelectric means carried in part fixedly on the transducer member and in part fixedly on the housing and operable for pulsing the transducer member and thereby actuating the pad for tempo signal transmission to the user without acoustical interference, and electrical means for operating the pulsing means and including means for selectively controlling the pulsing tempo of the pulsing means.

The present invention also provides a method of silent metronomic signalling which comprises generating silent controlled tempo signals, and dynamoelectrically translating the signals into silent motion of a soundproof transmitter and thereby transmitting the impulses to a user so that the user thereby receives tempo guidance by feeling impulses silently and without acoustical interference.

Other objects, features and advantages of the invention will be readily apparent in the following description of representative embodiments thereof, taken in conjunction with the accompanying drawings, although variations and modifications may be effected without departing from the spirit and scope of the novel concepts embodied in the disclosure and in which.

Figure 1:
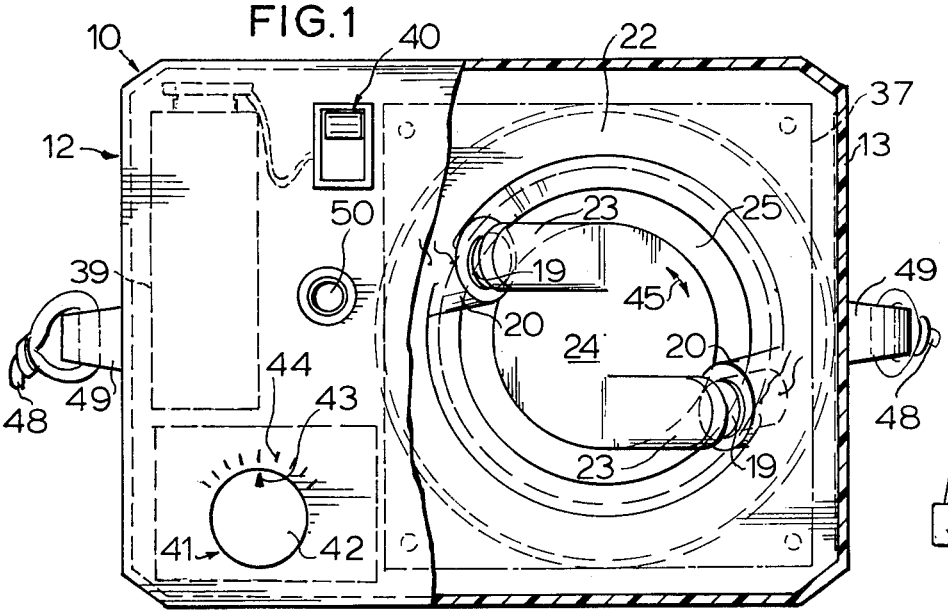
FIG. 1 is a plan view of a metronomic signalling device embodying the invention, and partly broken away and in section to reveal details.

A metronomic signalling device 10 (FIGS. 1 and 2) embodying the invention, and enabling practice of the method of the present invention, is desirably of a size and shape which will permit the device to be worn on the person of the user. To this end, the device comprises a body base portion 11 of generally rectangular form and which may be molded or otherwise shaped from any suitable material, but for practical purposes, desirably formed from a light-weight, durable plastic material. Removably carried by the base 11 is a snap-on detachable cover 12 formed from suitable thin plastic material so that a rim flange 13 with a lower edge inwardly projecting retaining bead 14 is retainingly engageable with a complementary latching shoulder 15 at the inner side of a rabbet groove 17 which provides an upwardly facing shoulder on which the edge of the flange 13 seats.

Within a housing space 18 provided by the assembled base portion 11 and cover 12, dynamo-electric means are provided for generating silent but physically sensible metronomic signal impulses, without acoustical interference comprising in an advantageous arrangement a balanced, cooperative pair of agitator electromagnets 19 mounted in respective diametrically opposite spaced bosses 20 located at the rim of a cavity 21 defined within a preferably integral thickened area 22 within the housing on the base member 11 and defining an opening from the house.

The arrangement and relationship of the electromagnets 19 is such that when the electromagnets are energized, they will attract cooperatively related, normally gapped, arms 23 of a metronomic impulse transducer, preferably comprising a disc-shaped member 24 of a magnetic material, such as soft iron, and from which the arms 23 integrally project divergently and tangentially from diametrically opposite marginal locations on the member 24, and in complementary positions for actuation by the respective electromagnets 19. Preferably, the transducer member 24 is carried by a soundproof relatively soft, yieldably movable transmission pad 25 having a substantial surface area facing inwardly, and to a major portion of; which area is secured fixedly the outwardly facing surface or face of the member 24, while the arms 23 project from the margin of the inwardly facing surface of the member. Any suitable and preferably soft rubber or rubber-like elastic material may be employed for the pad 25. On its outer face, the pad 25 desirably has an array of preferably rounded, spaced node projections or prods 27 providing a texture accentuated face. About its perimeter, the diaphragm 25 has means for securing it to the base member 11, comprising a preferably continuous peripheral attachment flange 28 which is adapted to be firmly clamped against an annular frustoconical shoulder 29 provided in an annular outwardly opening groove cavity 30 concentric with the outwardly opening cavity 21 in the thickened base area 22. A clamping ring nut 31 is adapted to be threadedly engaged by means of threads 32 with the base 11 within the annular cavity 30 and driven with its complementary frustoconical clamping surface 33 against the flange 28 of the pad 25 to clamp it securely against the clamping shoulder 29.

Pulsing operation of the electromagnets 19 is adapted to be effected by electrical means (FIGS. 1, 2 and 5) comprising an electrical circuit 34, components of which may be carried on a circuit board 35 mounted as by means of a thin mounting panel 37 on the inside roof surface provided by the top of the cap 12. Means such as a pulse cycling transistor or diode 38 and capacitor **38*a* are connected electrically to the electromagnets 19 and to a power source such as a battery 39. An on/off electrical switch 40 for the electrical circuit has suitable actuating means mounted conveniently on the cover 12. A pulse frequency or tempo control device 41 in the circuit 34 is adapted to be adjusted as by means of a knob 42 conveniently located on the cover 12 and desirably provided with an indicator 43 for visualizing adjustment relative to a tempo or pulse rate scale 44. Through this arrangement, when the circuit 34 is closed, the electromagnets 19 are energized and deenergized with a frequency determined by the adjustment of the tempo control 41. At each energization of the electromagnets 19 in each cycle, the impulse signalling device arms 23 are drawn toward the electromagnets, and then released on deenergizing of the electromagnets. This causes the impulse transducer 24 to push outwardly on the pad 25 and at the same time torque slightly in a counterclockwise direction as viewed in FIG. 1, and then return by virtue of the return spring action of the pad 25. This causes the projections 27 to thrust toward and impart an impulse to the skin S (FIG. 2) of a user contacted by the texture accentuated pad face. Thereby, the user receives tempo guidance by feeling the impulses through the skin. In FIG. 1, the double-headed arrow 45 indicates the oscillating cycle of the transducer member 24 as it is alternately actuated in a pulse and release cycle by the electromagnets 19. A double-headed arrow in FIG. 2 indicates the axial impulse and release cycle of the member 24. As a result, the user receives a definite and dual combined twisting and thrust sensation for each impulse. This is especially effective where an article of clothing intervenes between the device 10** and the skin of the user.

For convenience in use, the device 10 may be dimensioned to be carried in a garment pocket with the impulse transmitting pad 25 contiguous to the user's body. If preferred, the device 10 may be attached to the user's arm or leg or to any other convenient part of the use's body, and for this purpose attachment strand or strap means 48 may be provided attached to suitably positioned integral ears 49 at opposite ends of the base member 11 of the device.

Figure 5:
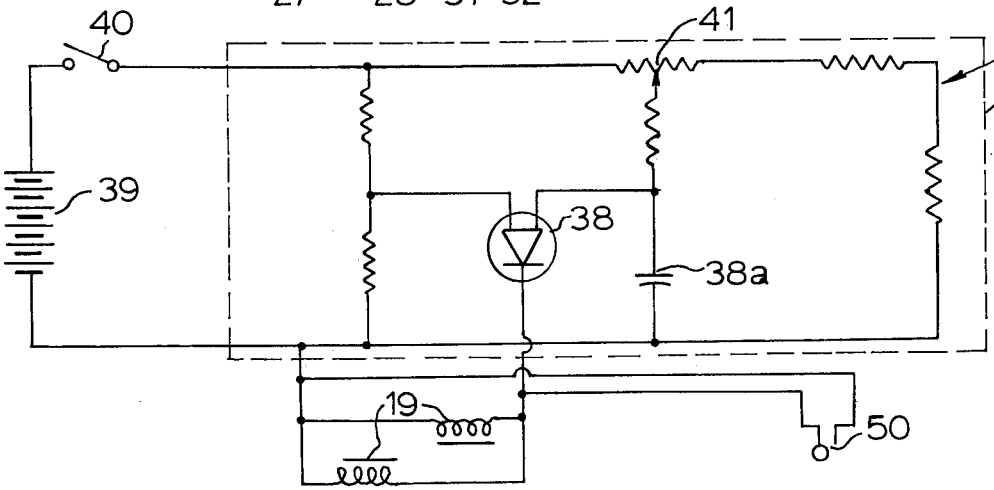
FIG. 5 is a schematic electrical diagram relevant to the operation of the device.

Means may be provided for connecting a plurality of metronomic signalling devices 10 together for tempo guidance of a plurality of persons simultaneously. For this purpose, the device 10 may be provided with one or more jack outlets 50 which may, as best seen in FIG. 5, be connected in the circuit 34 in parallel relation with the electromagnets 19. In such an arrangement, the additional metronomic signalling devices may be stripped-down versions of the device 10 in that they will operate in slave relation and will therefore require only the metronomic signalling means comprising the electromagnets 19, the pad 25 and the pad actuating member 24 with its arms 23, with the electromagnets 19 of the slave unit connected in parallel with the fully equipped device 10.

Figure 2:
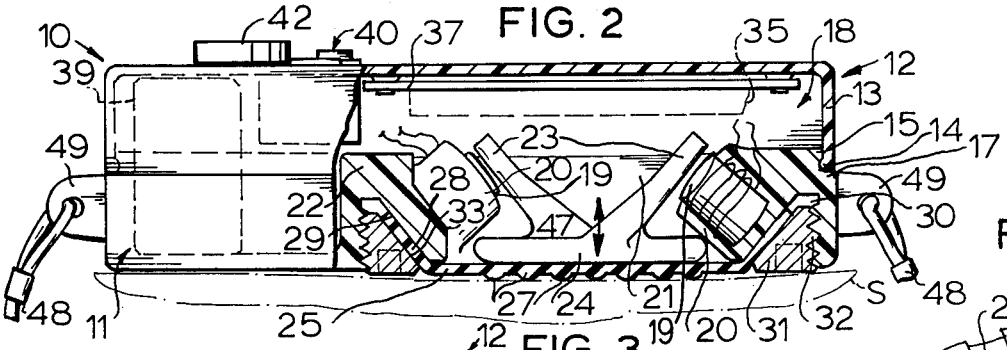
FIG. 2 is a side elevational view of the device of FIG. 1 with parts broken away and in section for revealing details.
Figure 3:
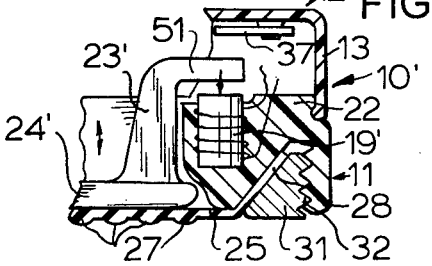
FIG. 3 is a fragmentary sectional elevational view showing a modification.

For merely reciprocations, as in FIG. 3, without oscillations, of the transducer member 24', there may be a single arm 23' on the member. Each such arm 23' has a terminal 51 which overlies the associated electromagnet 19' in a rectilinear fashion, wherein the electromagnet is located in a straight front-to-back relation rather than the diagonal relation as shown in FIG. 2. Thereby, at each energization of the electromagnet 19' of the device 10', the impulse imparting member 24' simply thrusts outwardly on the pad 25 to drive the prods or projections 27 toward the skin of the user for imparting the tempo guidance feeling sensation. In other respects, the device 10' may be identical with the device 10 of FIGS. 1 and 2, and common reference numerals identify substantially identical parts.

Figure 4:
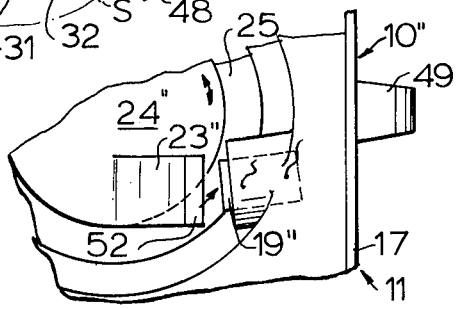
FIG. 4 is a fragmentary plan view showing another modification.

For simply oscillatory metronomic impulses, the arrangement depicted in FIG. 4 may be utilized. In this instance, the device 10'' may be essentially the same as the device 10 of FIGS. 1 and 2, except that electromagnets 19'' (only one being shown) are located on substantially horizontal axes considered in comparison to the vertical axis of FIG. 3 or the upwardly diagonal axes of FIG. 2. In this arrangement, the impulse transmission transducer disc or pad actuating member 24'' has its arms 23'' with its end facing in gap relation toward the associated electromagnet 19'' so that as the electromagnet 19'' is periodically energized, the member 24'' will be caused to move in one direction, that is counterclockwise as shown in FIG. 4. This will tension the pad 25 torsionally, and upon deenergization of the associated electromagnet and release of the transducer, this tension will bias and move the member 24'' in the opposite direction, as indicated by the double-headed arrow. As associated pad 25 is moved with the member 24'', the transmission prods on the pad will impart tempo guidance sensation to the user's skin.

If desired, the impulse transducer 24'' may be made from a non-magnetic material such as a suitable plastic, aluminum, or the like, and each of the arms 23'' may be equipped with a terminal 52 of magnetic material such as soft iron. It will be apparent that a similar structure may be employed in the respective forms of FIGS. 2 and 3, that is, the body disc and arms of the transducer member may be formed from non-magnetic material and a magnetic terminal provided on each of the arms.

Figure 6:
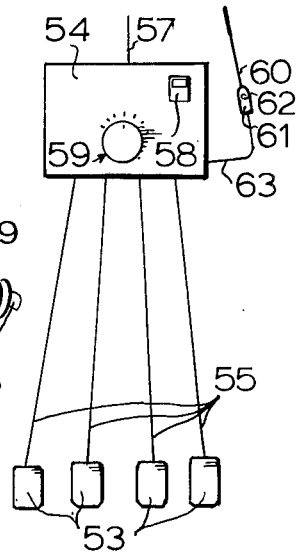
FIG. 6 is a schematic view showing how a plurality of metronomic devices according to the present invention may be motivated and controlled through a common control means.

A battery arrangement of metronomic signalling devices 53 is schematically depicted in FIG. 6 for transmitting tempo impulses simultaneously to a plurality of persons. All of the devices 53 are connected in slave relation to a control unit 54 common to all of the devices 53. Each of the slave devices 53 may comprise any of the metronomic impulse translating and transmitting means of FIGS. 1–4, or 8, or any other equivalent means, with a respective thin flexible electric permanent or plug-in lead connection 55 to the control box 54.

The control box may be equipped with means for generating metronomic impulse signals similarly as in the device 10 of FIG. 1, utilizing the circuit 34 of FIG. 5, but of increased capacity for accommodating the plurality of slave devices 53. Extra capacity power may be supplied from suitable source by adapter means as indicated at 57.

The controller 54 may also be equipped with an on/-off switch 58 and an easily accessible frequency or tempo control 59, similar to the control 41. In addition, or alternately, there may be connected to the controller 54 a conductor's baton 60, having a handle 61 equipped with a digital switch 62 as manual tempo impulse generating means adapted to override or bypass the metronomic impulse generating circuit 34' of the controller 59. A thin flexible head 63 may connect the baton 60 in circuit with the controller 59. As will be apparent, the arrangement of FIG. 6 permits a conductor or instructor to provide tempo guidance for a plurality of players or students in an orchestra.

Figure 7:
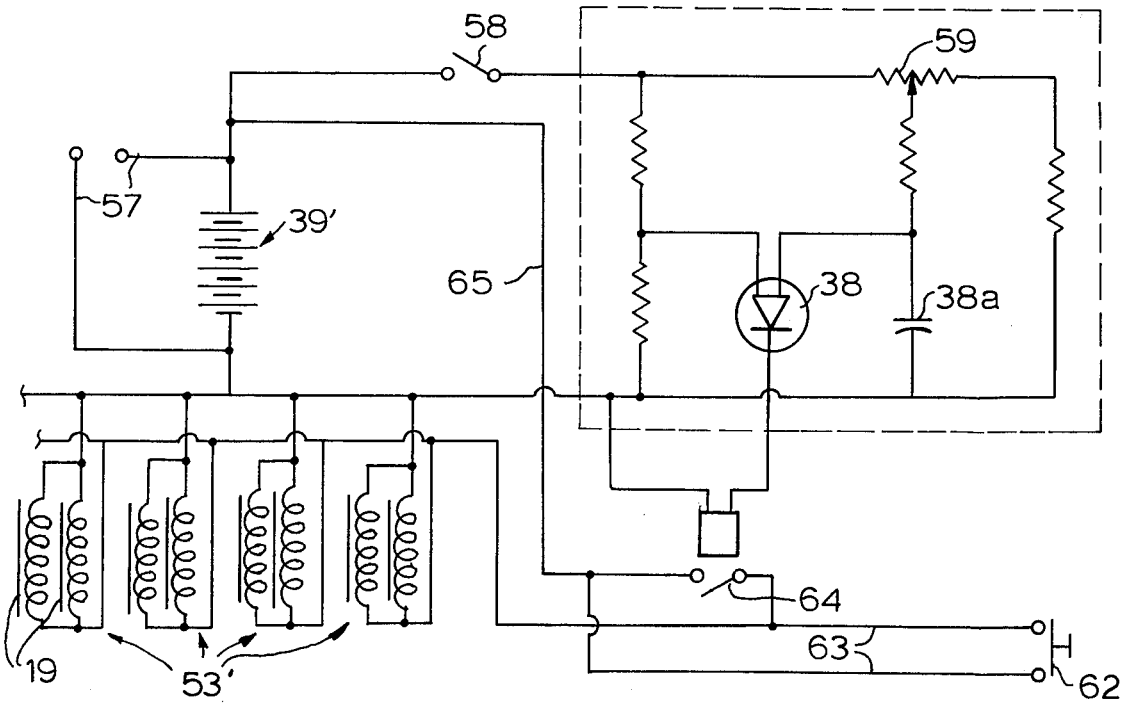
FIG. 7 is a schematic electrical diagram especially relevant to the arrangement of FIG. 6.

Referring to FIG. 7, a circuit arrangement especially relevant to FIG. 6 is depicted and which will provide a plurality of tempo guidance options, including a manual tempo pulse signal generating means. To this end, as large a number of metronomic signalling units 53 as desired is adapted to be selectively connected with the metronomic signal generating circuit 34' which functions substantially the same as the circuit 34 in FIG. 5. Electrical energy is provided by a power source such as a battery 39' or, where extra capacity is demanded, by the adapter means 57 connecting to a compatible external power source. When the pulse rate control 59 is set at a desired tempo and the switch 58 is closed, the electrical circuit 34' is energized for tempo pulsing action at a tempo rate indicated on the control 59. Each pulse closes a relay switch 64, preferably of a silent kind, which correspondingly closes a pulsing circuit 65 across the power source 39' (or 57) for actuating the solenoids 19' of the slave units 53 in unison. Thereby, all of the slave units 53 are actuated to transmit desired steady metronomic tempo impulses through these slave units.

Should the conductor encounter music where an accelerating, decelerating or a flexible tempo is demanded, he may control the tempo manually through the slave units 53 by opening the control switch 58. In this mode, the conductor or instructor may operate by tapping the normally open-biased pulsing switch key 62 carried on his baton. As shown, the manual switch 62 is connected in the pulsing circuit 65 in such manner that at each closing of the switch 62, the pulsing circuit 65 is closed and all of the signalling units 53 activated. By not tapping the switch key 62, the conductor may use the baton in a conventional way, although the silent tempo signalling guidance, either machine timed or manually pulsed, allows him a freer use of the baton to interpret the musical expression of the work. When the guidance is machine timed the conductor may wear one of the signalling units 53 to monitor the tempo for himself. It is understood that the control box 54 may be located in proximity to the conductor during use to allow him easy access to the control knobs or buttons. Where the musical activity is not confined to a fixed position, a modification may be embodied to transmit the metronomic signals from controller 54 to the units 53 via radio wave, or wireless control of a character easily provided in accordance with the present state of the electronic arts.

Figure 8:
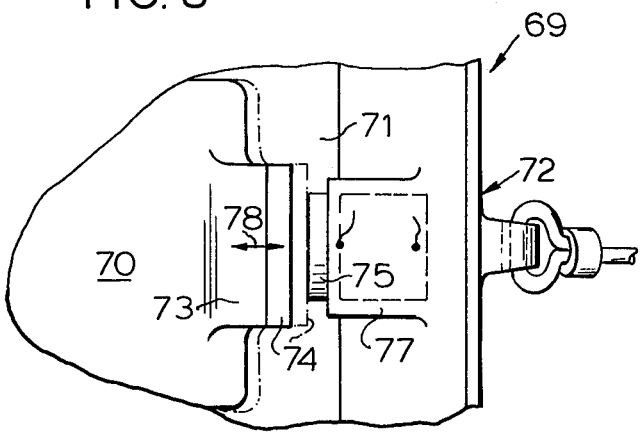
FIG. 8 is a fragmentary plan view showing a further modification of the device.

In FIG. 8 is depicted a modified metronomic signalling device 69 which may be a self-contained unit such as in FIGS. 1 and 2, or a slave unit such as the slave units 53 or 53', but is provided with a transducer 70 adapted to be actuated in a rectilinear manner parallel to the tempo impulse transmission pad 71 carried by, and across an opening in, the bottom of housing 72. In this instance, the transducer 70 may be in the form of a generally rectangular panel fixedly attached to the pad 71, which may also be of generally rectangular form. Although the transducer member 70 may be made from a suitable magnetic material, it may for practical purposes be made from a suitable lightweight plastic material and provided with a marginally located arm 73 having a terminal 74 of a suitable magnetic material, such as soft iron. Normally, the terminal 74 is in gap relation as shown in full outline with respect to an electromagnet actuator 75 mounted in a boss 77 within the housing 72. Energization of the electromagnet 75 draws the terminal 74 and thereby the transducer 70 in one rectilinear direction, and upon deenergization the bias provided by the resilient pad 71 automatically returns the transducer 70 to initial position, such action being indicated by the double-headed directional arrow 78. Operating control of the device 69 may be effected similarly as described in connection with FIGS. 1–2, 5 or 7.

It will be understood that variations and modifications may be effected without departing from the spirit and scope of the novel concepts of this invention.

I claim as my invention:

1. A silent metronomic pulsing device, comprising:

a housing having an opening;

a soundproof relatively soft, yieldably movable transmission pad fixed across said opening and having a texture accentuated face projecting outwardly from said housing for tempo-signal-imparting engagement with a user, and a surface of substantial area facing inwardly into said housing;

transducer means comprising a disk-like member fixed to and movable with said inwardly facing surface of the soundproof pad and covering a major portion of said area;

dynamoelectric means carried in part fixedly on said member and in part fixedly on said housing and operable for pulsing said member and thereby actuating said pad for tempo signal transmission to the user without acoustical interference;

and electrical means for operating said pulsing means and including means for selectively controlling the pulsing tempo of the pulsing means.

2. A device according to claim 1, wherein said dynamoelectric means part carried fixedly on said member comprises at least one rigid arm located along a margin of said member and adjacent to a margin of said pad, and said part carried on said housing comprises an electromagnet adjacent to said margin.

3. A device according to claim 2, wherein said parts are in narrow gap relation so that in the operation of said pulsing means said member-carried part will be alternately drawn in said gap toward said housing-carried part and released for thereby effecting pulsing of said member and actuating of said pad.

4. A device according to claim 1, wherein said parts are normally in gap relation by virtue of resilient return spring action of said pad so that in the operation of said pulsing means are member-carried part will be alternately drawn in said gap toward said housing-carried part and released for thereby effecting said pulsing of said member and actuating of said pad.

5. A device according to claim 1, wherein said dynamoelectric pulsing means is adapted to effect oscillatory and reciprocatory pulsing movements of said transducer member and said pad.

6. A device according to claim 1, wherein said electrical operating means is located in said housing adjacent to said transducer means.

7. A device according to claim 1, wherein said electrical operating means is housed in a separate housing, and an electrical connection connects said operating means with said dynamoelectric pulsing means.

8. A device according to claim 7, wherein said means for selectively controlling the pulsing tempo of said pulsing means comprises a conductor's baton electrically connected with said electrical operating means and having digital control switch means mounted on the baton.

9. A silent metronomic signalling device, comprising:

means for generating silent tempo signals;

means for controlling the tempo of said signals;

and means for translating said signals into impulses and transmitting the impulses to a user and comprising an electromagnetic actuator and a soundproof transmitter actuated by the actuator for transforming the signals into silent but sensible impulses;

said actuator being operative to cause oscillatory and reciprocatory impulse movements of said transmitter.

10. A method of silent metronomic signalling, comprising:

generating silent controlled tempo signals;

controlling said tempo signals;

and translating said signals into oscillatory and reciprocatory impulses of a soundproof transmitter and thereby transmitting the impulses to a user so that the user receives tempo guidance by feeling said impulses.

11. A method according to claim 10, comprising transmitting said impulses through a plurality of separate units in contact with separate persons, and generating said tempo signals and effecting said tempo control at a location remote from said units.

12. A method according to claim 11, which comprises effecting said tempo control from a conductor's baton.

13. A method of silent metronomic signalling, comprising:

generating silent tempo signals;

controlling said tempo signals;

and translating said signals dynamoelectrically into silent motion impulses of a soundproof transmitter and thereby transmitting the impulses to a user so that the user receives tempo guidance by feeling said impulses silently.

14. A method according to claim 13, comprising transmitting said silent motion impulses through a plurality of separate units for transmitting such impulses to separate users, and generating said tempo signals and controlling said tempo signals at a location remote from said units.

15. A method according to claim 14, which comprises controlling said tempo signals from a conductor's baton.

* * * * *